US008503152B2

(12) United States Patent
Feltz et al.

(10) Patent No.: US 8,503,152 B2
(45) Date of Patent: Aug. 6, 2013

(54) CIRCUIT BOARD MOUNTABLE SOLENOID ACTUATOR

(75) Inventors: Brad S. Feltz, Holland, NY (US); Walter F. Wike, Jr., Lancaster, NY (US); Kevin R. Heffler, Youngstown, NY (US)

(73) Assignee: American Precision Industries, Inc., East Aurora, NY (US)

( * ) Notice: Subject to any disclaimer, the term of this patent is extended or adjusted under 35 U.S.C. 154(b) by 214 days.

(21) Appl. No.: 13/018,983

(22) Filed: Feb. 1, 2011

(65) Prior Publication Data

US 2012/0092803 A1 Apr. 19, 2012

Related U.S. Application Data

(60) Provisional application No. 61/393,136, filed on Oct. 14, 2010.

(51) Int. Cl.
*H01H 9/00* (2006.01)
*H01H 47/00* (2006.01)
*H01H 47/04* (2006.01)

(52) U.S. Cl.
USPC ..... 361/206

(58) Field of Classification Search
USPC ..... 361/206
See application file for complete search history.

(56) References Cited

U.S. PATENT DOCUMENTS 4,443,775 A 4/1984 Fujitani et al.
4,476,451 A 10/1984 Kosugi
4,513,652 A 4/1985 Muramatsu et al.
4,736,177 A 4/1988 Vollmer et al.
4,863,143 A 9/1989 Cowley et al.
5,239,277 A 8/1993 Vielot
5,272,458 A 12/1993 Hoffman et al.
5,310,271 A 5/1994 Andou et al.
5,575,309 A 11/1996 Connell
5,856,771 A 1/1999 Nippert
5,933,067 A 8/1999 Frolov
6,144,275 A 11/2000 Hirata et al.
6,155,503 A 12/2000 Benson et al.
6,414,406 B1 7/2002 Ikoma et al.
6,433,662 B1 8/2002 Ikoma et al.
7,388,460 B2 6/2008 Hoffman
7,646,273 B2 1/2010 Kobayashi
2010/0127807 A1* 5/2010 Hammond ..... 335/255

* cited by examiner

*Primary Examiner* — Dharti Patel

(74) *Attorney, Agent, or Firm* — Robert L. Wolter, Esq.; Beusse Wolter Sanks Mora & Maire, P.A.

(57) ABSTRACT

An infinitely variable multi-directional linear motion solenoid actuator (10) for use on printed circuit boards (12). The solenoid actuator includes wire coils (14) wound onto a bobbin (16) and a moveable magnetic armature (18) passing through a central bore (20) of the body. The armature is responsive to current passing through the coils to produce infinitely variable and reversible motion. Support posts (22) passing through the bobbin are used for electrical connection between the coils and the circuit board, as well as for mounting the actuator to the circuit board. The support posts may have solder heads on one end for surface mounting to the board, and may have plain heads on an opposed end for alternative through-hole mounting. A vacuum pick area (56) may be formed on one or both sides of the bobbin body to facilitate automated handling of the actuator.

19 Claims, 2 Drawing Sheets

CIRCUIT BOARD MOUNTABLE SOLENOID ACTUATOR

This application claims benefit of the 14 Oct. 2010 filing date of U.S. provisional application No. 61/393,136, incorporated by reference herein.

FIELD OF THE INVENTION

This invention relates generally to the field of actuators, and more particularly to the field of linear motion solenoid actuators, and specifically to a solenoid actuator configured for mounting on a printed circuit board, providing infinitely variable multi-directional linear motion in one embodiment.

BACKGROUND OF THE INVENTION

Electro-mechanical solenoid actuators (or solenoids) are well known in the art for providing linear mechanical motion in response to an electrical power input. A solenoid actuator typically includes a moveable magnetic armature (also called a core element, plunger or slider element) which is positioned within a bore of a wire coil. The coil is selectively energized with an electrical current to create a magnetic field, which in turn exerts an electro-magnetic force to move the armature in a first direction within the bore. Return movement of the armature may be energized by a return spring, by reversing the direction of current flowing through the wire coil, or by selectively energizing a second wire coil.

Solenoids are used in many applications, for example, for mechanically actuating electric door locks, fluid flow control valves, circuit interrupters, printer heads, automatic player pianos, automobile starters, and cameras, to name just a few. Solenoids are generally relatively large devices designed to produce a relatively large amount of mechanical force, and they are typically attached by screws or bolts to a support structure is adjacent to the mechanical device that the solenoid is intended to actuate, and that is separate and spaced apart from the controller for the solenoid and the driver circuits controlling the operation of the solenoid

BRIEF DESCRIPTION OF THE DRAWINGS

The invention is explained in the following description in view of the drawings that show.

DETAILED DESCRIPTION OF THE INVENTION

The present inventors have innovatively recognized a need to provide remotely controllable mechanical movement on a printed circuit board (PCB; also called printed wiring board, PWB). While it is known to place mechanical devices such as dual in-line package (DIP) switches on circuit boards, such mechanical devices are operated manually, thereby requiring physical access to the board. An example of such an application is a circuit board associated with an electric garage door opener which is programmable to recognize only a single remote control device by the selective positioning of typically eight DIP switches on the circuit board. Resetting of the program code requires physical access to the inside of the case of the garage door opener, which is typically mounted on the ceiling of the garage, thereby requiring the home owner to open the case and to manipulate the DIP switches while on a ladder. It is also known to incorporate micro-electromechanical systems (MEMS) on a printed circuit board; however, the very small scale of such devices (0.001 to 0.1 mm) limits the range of motion and the amount of motive force that they provide, and therefore limits their usefulness.

The present invention broadens the horizon of design possibilities for printed circuit board assemblies by providing a solenoid actuator which can be mounted on a printed circuit board, and which can be arranged on the board to provide remotely controllable mechanical motion to a cooperating operating device, such as a switch, valve, rheostat, etc. In one embodiment, the solenoid actuator may be configured for surface mounting to the circuit board using known automated board populating equipment. Thus the PCB may be adapted to carry the circuitry for controlling and driving the operation of the solenoid. The PCB may also carry the mechanical device to be actuated by the solenoid as well as other circuitry such as that associated with the mechanical device.

Figure 1:
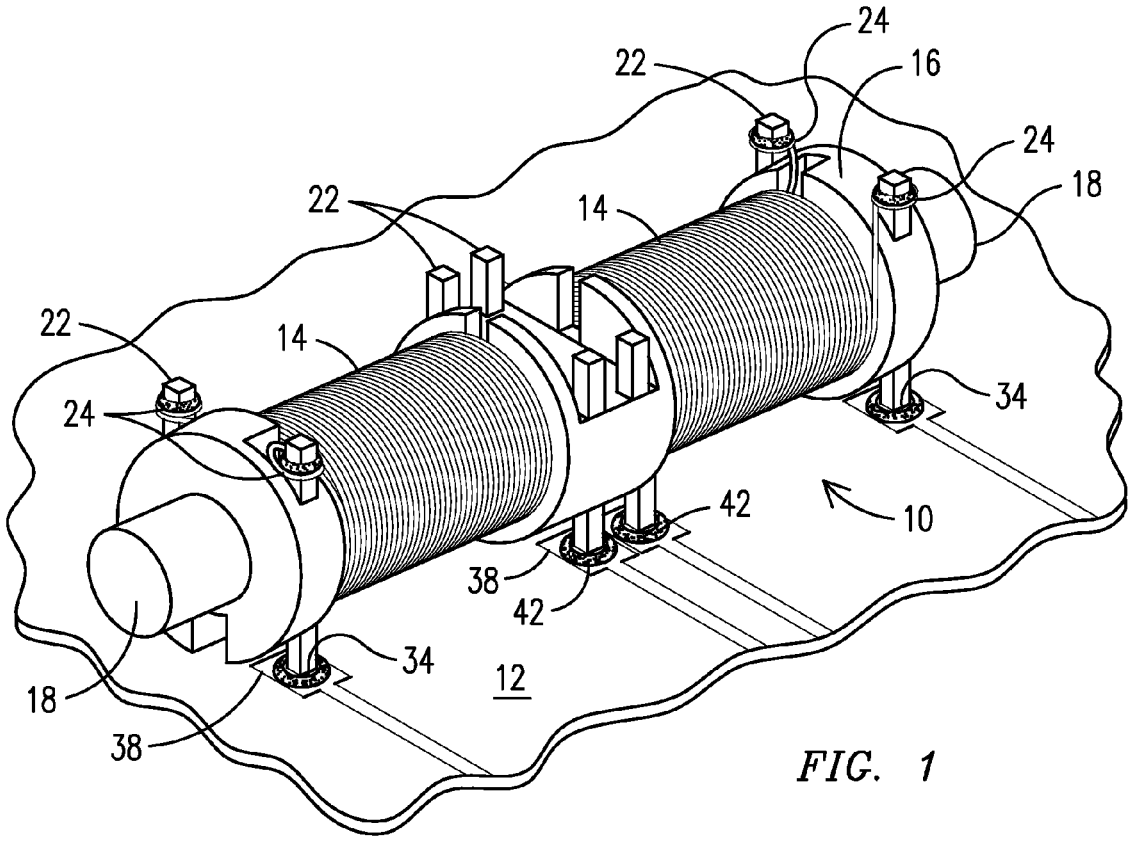
FIG. 1 is a perspective view of a solenoid actuator in accordance with one embodiment of the invention.
Figure 2:
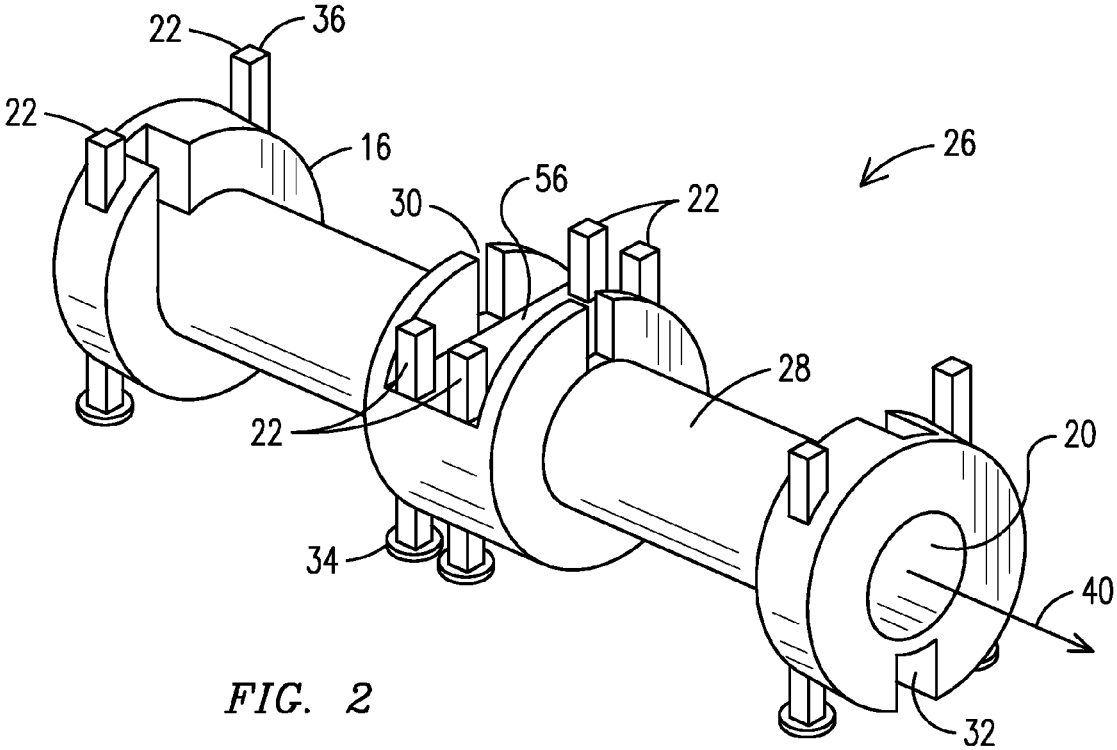
FIG. 2 is a top perspective view of a bobbin assembly forming part of the solenoid actuator of FIG. 1.
Figure 3:
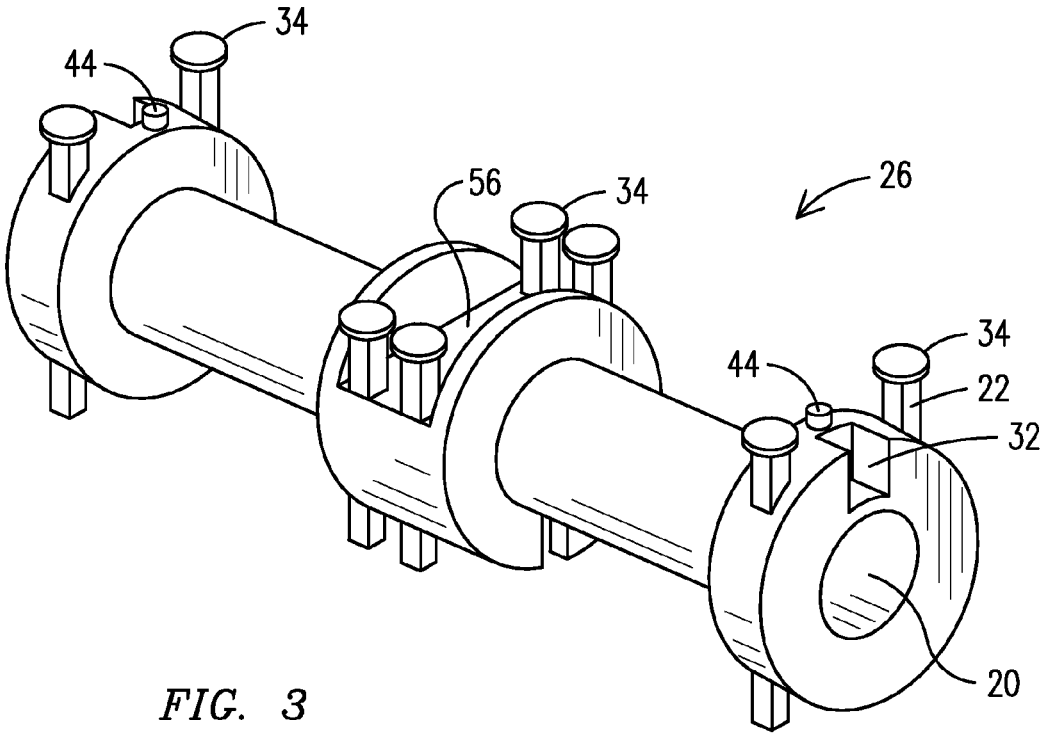
FIG. 3 is a bottom perspective view of the bobbin assembly of FIG. 2.

One embodiment of the invention is illustrated in FIGS. 1-3. FIG. 1 is a perspective view of an assembled solenoid actuator 10 that is ready for surface mounting on a printed circuit board 12. The solenoid actuator 10 of FIG. 1 includes two independent wire coils 14 (field coils) disposed along an axial length of a bobbin 16. The bobbin 16 may be formed of a suitable electrically insulating material, such as plastic, and the coils 14 may be wound of any known gauge of insulated wire using techniques known in the art to achieve a desired flux density when energized with an electrical current. An armature 18 is made of a suitable magnetic or magnetizable material and is moveably disposed in an axially extending hollow center bore 20 of the bobbin. The armature 18 is thus made to move by selectively energizing one or both coils 14, thereby creating an electro-magnetic field for linear mechanical movement of the armature 18 in response to the controllable electrical currents passing through the coils.

In one embodiment of the solenoid as shown in the drawings, eight support posts 22 are attached to the bobbin and are disposed to pass through the bobbin to extend on opposed sides of the bobbin. At least some of the support posts 22 are formed of an electrically conductive material and also serve as conductive terminals. In the embodiment of FIG. 1, the four wire ends 24 of the two wire coils 14 are terminated on the respective four electrically conductive support posts 22 at the opposed ends of the bobbin 16, and the four support posts 22 proximate the axial center of the bobbin 16 are not used for coil wire termination. One skilled in the art will appreciate that in other embodiments, different combinations of support posts may be used for the electrical termination of the respective coil wire ends for different combinations of coils and connections. The support posts 22 may have a generally rectangular cross-sectional shape in order to facilitate the wire end termination using automated equipment. The bobbin 16 and support posts 22 may be referred to collectively as a bobbin assembly 26 as illustrated in FIGS. 2 and 3. As described more fully hereinafter, the support posts 22 also serve to connect the solenoid actuator 10 to the printed circuit board 12. Different numbers of support posts 22 may be used, such as 4 or 6 in some embodiments, depending on the size and number of coils 14.

The bobbin assembly 26 of the solenoid actuator 10 of FIG. 1 is illustrated in more detail in FIGS. 2 and 3. FIG. 2 is a top perspective view of the bobbin assembly 26 and FIG. 3 is a bottom perspective view of the same device. The hollow center bore 20 of the bobbin 16 is clearly illustrated in FIGS. 2 and 3, as are two coil annular recesses or windows 28 formed in the exterior surface of the bobbin to accept the wire coils. One or more wire passages 30 may be formed in the walls of the coil windows 28 to facilitate the routing of the coil wire ends 24 toward the electrically conductive support posts 22. Furthermore, one or more fixturing features, such as key-hole slots 32, may be formed in the bobbin 16 to cooperate with winding equipment that may be used when winding the wire coils.

The support posts 22 may be formed to have a solder head 34 on one end and a plain head 36 on an opposed end. This arrangement allows the solenoid actuator 10 to be secured to a printed circuit board 12 by surface mounting of the solder heads 34 against respective mounting pads 38 on the board, or alternatively, by through-hole mounting of the plain heads into respective receiving holes (not illustrated) in the board. Choosing between the two alternative mounting arrangements is made by simply rotating the solenoid actuator 10 180° about its bore axis 40 to, in effect, turn the solenoid upside down. Alignment of the plain head ends of the support posts with the receiving holes in the board will ensure proper alignment of the solenoid actuator 10 on the board. However, the generally flat bottom surfaces of the solder heads 34 are free to move in relation to the respective cooperating mounting pads 38 until the connecting solder 42, thereby creating the possibility for a degree of misalignment of the solenoid actuator 10. For embodiments where such possible misalignment is undesirable, an alignment feature, such as the pair of alignment pins 44 illustrated in FIG. 3, may be formed on the bottom or under side of the bobbin proximate the solder heads 34 for cooperating with an alignment feature such as holes (not shown) on the printed circuit board 12 to align the solenoid actuator 10 for surface mounting.

Figure 4:
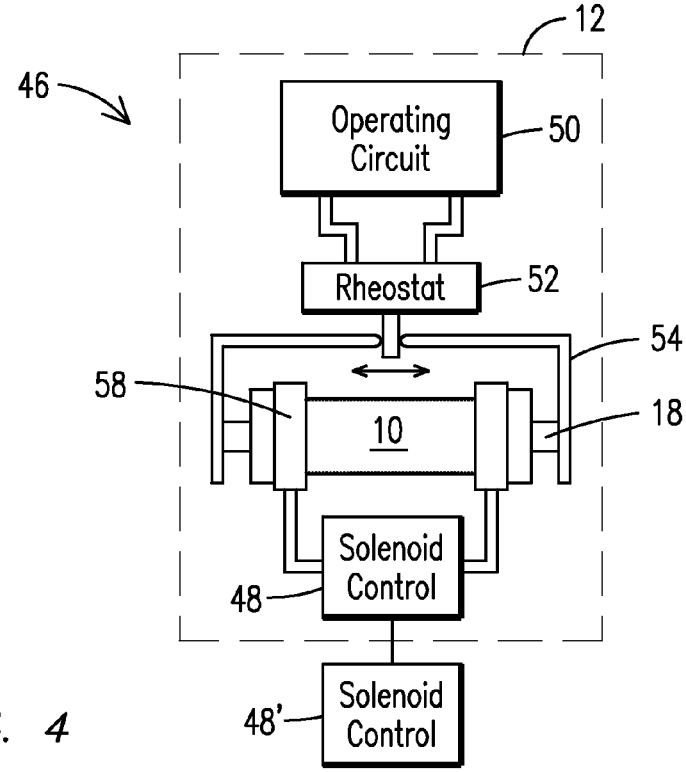
FIG. 4 is a schematic illustration of a printed circuit board assembly including a surface mounted solenoid actuator and a mechanical device to be actuated by the actuator.

FIG. 4 is a schematic illustration of a circuit board assembly 46 including a solenoid actuator 10 in accordance with one embodiment of the invention. A solenoid actuator 10, such as the one illustrated in FIG. 1, is mounted on a printed circuit board 12. Also formed on the board are at least portions of a control and driver circuit 48 for controlling the operation of the solenoid, which circuit may be self-contained on the board and/or may be in communication with additional off-board solenoid control elements 48', and which at least include a conductor in electrical communication with the solenoid actuator 10. An operating circuit 50 may also be formed on the board that includes a mechanically operable device 52 to be actuated by the solenoid actuator 10 and exhibiting at least two operating states in response to a mechanical motion input, for example a switch or valve having an "on" and an "off" position. The solenoid actuator 10 and the operating device 52 are mounted on the board 12 in a cooperating physical arrangement such that movement of the armature 18 of the actuator 10 provides the mechanical motion input to the operating device 52 effective to select among the operating states of the operating device. As illustrated in the embodiment of FIG. 4, there may be a connecting linkage 54 between the armature 18 of the solenoid actuator 10 and the operating device 52. The mechanical device to be actuated by the solenoid may also be mounted on a structure adjacent to the printed circuit board in other embodiments.

A solenoid actuator 10 according to an aspect of the invention may be installed onto printed circuit board 12 using automated board populating equipment. To facilitate handling of the actuator by an automated machine arm, one or more vacuum pick areas 56 may be formed on the bobbin. The vacuum picks areas 56 are relatively flat, planar areas which can be accessed by a vacuum pick arm without obstruction by other structures of the actuator. In the embodiment illustrated in FIGS. 2 and 3, a vacuum pick area 56 is provided proximate a center of the bobbin assembly 26 on each of the top and bottom of the device in order to facilitate the installation of the actuator in either its surface mount or through-hole mount configurations.

Once the wire coil(s) 14 are wound onto the bobbin 16 and the coil wire ends 24 are terminated to respective support posts 22, the armature 18 is installed into the hollow center bore 20 and the completed solenoid actuator 10 is ready for installation onto a printed circuit board 12. The actuator 10 may be handled by an automated board population machine arm via its vacuum pick area(s) 56, and the actuator 10 is positioned onto the board 12, such as by aligning the solder heads 34 with respective mounting pads 38 on the board 12, or by inserting either alignment pins 44 and/or plain head ends 36 of the support posts 22 into respective holes (not shown) in the board 12. Mechanical and electrical connection of the solenoid actuator 10 to the printed circuit board 12 is then made, such as by a known soldering process. The coil(s) 14 of the actuator 10 may then be selectively energized via a solenoid control circuit 48 on the board in order to move the armature 18 to a desired position. In the embodiment of FIG. 4, the armature 18 is retained within the hollow bore 20 of the bobbin 16 by physical restrictions imposed by the connecting linkage 54; although in other embodiments a physical motion stop feature may be designed into the actuator itself. A spring-return feature as is known in the art may be incorporated into the device.

For the two-coil embodiment of FIGS. 1-3, the armature 18 may be driven toward either one of the coils 14 by selectively energizing that coil alone. Alternatively, the armature 18 may be driven to a selected intermediate position by simultaneously energizing both coils 14 with different levels of electrical current, thereby providing a continuously variable position control for the solenoid actuator 10.

One skilled in the art will appreciate that other embodiments of the present invention may include a solenoid actuator 10 having a different number of field coils 14 and support posts 22 than those illustrated herein. The illustrated arrangement of support posts 22 at both the opposed ends and proximate a center region of the bobbin 16 provides effective mechanical support for the entire mechanism, thereby allowing a thickness of the bobbin material between the wire coils 14 and the armature 18 at the bottom of the coil windows 28 to be minimized, thereby maximizing the flux input from the coils 14 into the armature 18 and optimizing an amount of mechanical force that can be generated by the actuator 10. Furthermore, a magnetic shield 58, such as a metal jacket disposed around the coils as schematically illustrated in FIG. 4, may be used to concentrate the flux density passing through the armature 18, thereby further increasing the mechanical power output of the device.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. A solenoid actuator for use on a printed circuit board for actuating a mechanically actuatable device, the solenoid actuator comprising:

a bobbin comprising a hollow bore;

at least one wire coil wound about the bobbin for generating a magnetic field when electrically energized;

an armature disposed within the hollow bore and moveable between first and second positions within the bore under a motive force of the magnetic field by selectively energizing the at least one wire coil;

a plurality of support posts projecting from the bobbin, the support posts being configured for securing the solenoid actuator to a printed circuit board having driver circuitry for providing electrical power for the solenoid actuator; and at least some of the support posts being formed of an electrically conductive material for terminating respective wire ends of the at least one coil, thereby providing both a mechanical connection of the solenoid actuator to the printed circuit board for affixedly mounting the solenoid actuator on the printed circuit board and electrical connections between the ends of the at least one coil and the driver circuitry on the printed circuit board for conducting electrical power from the printed circuit board to the ends of the coil to generate a magnetic field for moving the armature.

2. The solenoid actuator of claim 1, further comprising a solder head formed at a bottom of each conductive support post for surface mounting the solenoid actuator to the printed circuit board.

3. The solenoid actuator of claim 2, further comprising an alignment feature formed on a side of the bobbin proximate the solder heads for cooperating with an alignment feature on the printed circuit board to align the solenoid actuator for surface mounting on the printed circuit board.

4. The solenoid actuator of claim 2, wherein the bobbin further comprises a first vacuum pick area on a side of the bobbin opposed the solder heads.

5. The solenoid actuator of claim 2, further comprising a plain head formed at an end of each conductive support post opposed the respective solder head for alternative through-hole mounting the solenoid actuator to the printed circuit board.

6. The solenoid actuator of claim 5, wherein the bobbin comprises a first vacuum pick area on a side of the bobbin opposed the solder heads, and further comprises a second vacuum pick area on a side of the bobbin opposed the plain heads.

7. The solenoid actuator of claim 1, further comprising a winding equipment fixturing feature formed on the bobbin.

8. The solenoid actuator of claim 1, further comprising:

a first coil window and a second coil window formed in the bobbin;

first and second wire coils wound within the respective first and second coil 15 windows; and two support posts proximate a first end of the bobbin, two support posts proximate a second end of the bobbin opposed the first end, and a support post proximate a middle of the bobbin between the first and second coil windows.

9. A bobbin assembly for a solenoid actuator adapted to be mounted on a printed circuit board, the bobbin assembly comprising:

a bobbin body comprising an axially oriented central bore and at least two coil windows formed in an exterior surface of the bobbin body, with each window being adapted to receive a respective coil of wire wound on the bobbin; and a plurality of support posts extending through the bobbin body, including at least one support post at each of a first end of the bobbin body, a second end of the bobbin body opposed the first end, and in a central region of the bobbin body between the at least two coil windows for enabling the bobbin to be affixedly mounted on the printed circuit board, with at least some of the support posts being formed of an electrically conductive material for terminating respective wire ends of the coils and providing an electrical connection between the coils to the printed circuit board tor conducting electrical power from the printed circuit board and the wire ends of the coils for energizing the coils;

a solder head formed on a first end of each support post for enabling a soldered connection between the bobbin and the printed circuit board.

10. The bobbin assembly of claim 9, further comprising a flat vacuum pick area formed on a side of the bobbin body opposed the solder heads.

11. The bobbin assembly of claim 9, further comprising at least two alignment pins formed on a side of the bobbin body proximate the solder heads.

12. The bobbin, assembly of claim 9, further comprising a winding equipment fixturing feature formed on the bobbin body.

13. A solenoid actuator comprising the bobbin assembly of claim 9.

14. A printed circuit board assembly comprising:

a printed circuit board carrying electrically conductive traces thereon and comprising at least a portion of a solenoid control circuit; and a solenoid actuator comprising a coil for generating a magnetic field when electrically energized and an armature movably mounted within the coil in response to changes in the magnet field, with the solenoid actuator being mechanically mounted to the printed circuit board and electrically connected to the solenoid control circuit via the electrically conductive traces for selectively providing electrical power from the solenoid control circuit to the coil for movement of the armature within the coil.

15. The assembly of claim 14, further comprising:

an operating device mounted to the board, the operating device exhibiting at least two operating states in response to a mechanical motion input to the operating device; and the solenoid actuator and the operating device being mounted on the board in a cooperating physical arrangement such that movement of the armature provides the mechanical motion input to the operating device effective to select among the operating states of the operating device.

16. The assembly of claim 15, further comprising a linkage positioned between the solenoid actuator and the operating device for transferring motive force from the armature to the operating device.

17. The assembly of claim 15, further comprising:

the solenoid actuator comprising at least two coils for providing movement of the armature; and the solenoid control circuit being configured to selectively energize the at least two coils to drive the armature to selected positions within a range of motion relative to the coils.

18. The assembly of claim 17, wherein the operating device comprises a rheostat, or a valve for controlling fluid flow.

19. The assembly of claim 14, wherein the solenoid actuator further comprises:

a bobbin comprising a hollow bore;

the coil wound about the bobbin for generating a magnetic field when electrically energized;

the armature disposed within the hollow bore and moveable within the bore in response to the magnetic field; and a plurality of support posts projecting from the bobbin, the support posts being configured for securing the solenoid actuator to the board, and at least some of the support posts being formed of an electrically conductive material for terminating respective wire ends of the coil, thereby providing both a mechanical connection of the solenoid actuator to the board and an electrical connection for conducting electrical power between the coil and the solenoid control circuit.

* * * * *